US010281869B2

(12) United States Patent
Uchida

(10) Patent No.: US 10,281,869 B2
(45) Date of Patent: May 7, 2019

(54) IMAGE FORMING APPARATUS

(71) Applicant: Brother Kogyo Kabushiki Kaisha, Nagoya (JP)

(72) Inventor: Mariko Uchida, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 16/040,778

(22) Filed: Jul. 20, 2018

(65) Prior Publication Data

US 2019/0033775 A1 Jan. 31, 2019

(30) Foreign Application Priority Data

Jul. 25, 2017 (JP) ..... 2017-143774

(51) Int. Cl.
*G03G 15/00* (2006.01)
*G03G 21/16* (2006.01)

(52) U.S. Cl.
CPC ..... *G03G 21/1623* (2013.01); *G03G 21/1633* (2013.01); *G03G 21/1661* (2013.01); *G03G 21/1695* (2013.01)

(58) Field of Classification Search
CPC ..... G03G 21/1623; G03G 21/1633; G03G 21/1638; G03G 21/1661; G03G 21/1695; G03G 15/1605; G03G 15/6529; G03G 15/6552
See application file for complete search history.

(56) References Cited

U.S. PATENT DOCUMENTS 8,511,670 B2 * 8/2013 Maeda ..... B65H 1/04 271/10.02
9,459,585 B2 * 10/2016 Yoshikawa ..... G03G 21/1604
2006/0140694 A1 6/2006 Yano

FOREIGN PATENT DOCUMENTS

JP 2004-359364 A 12/2004
JP 2006-154557 A 6/2006
JP 2007-031034 A 2/2007
JP 2016-155650 A 9/2016

* cited by examiner

*Primary Examiner* — Hoang X Ngo
(74) *Attorney, Agent, or Firm* — Burr & Brown, PLLC

(57) ABSTRACT

An image forming apparatus includes a casing having first opening, a cover attached to the casing and having a second opening, a tray attached to the cover, an engaging mechanism, and an elastic member. The cover is pivotable around a first pivot axis located nearer its lower end portion than to its upper end portion to cover or expose the first opening. The tray is pivotable around a second pivot axis between an accommodated position to cover the second opening and a use position to expose the second opening. A lower end portion of the tray is disposed below the second pivot axis. The engaging mechanism is configured to engage the tray in the accommodated position with the cover. The elastic member is configured to press the lower end portion of the tray such that the tray moves from the accommodated position toward the use position.

10 Claims, 12 Drawing Sheets

IMAGE FORMING APPARATUS

CROSS-REFERENCE TO RELATED APPLICATION

This application claims priority from Japanese Patent Application No. 2017-143774 filed on Jul. 25, 2017, the content of which is incorporated herein by reference in its entirety.

TECHNICAL FIELD

Aspects of the disclosure relate to an image forming apparatus including a casing, a cover pivotally attached to the casing, and a tray pivotally attached to the cover.

BACKGROUND

A known image forming apparatus, e.g. a laser printer, includes a casing and a cover attached to the casing. The casing has a first opening for clearing a sheet jam or replacing a process device. The cover is movable to cover or expose the first opening. The cover has a second opening for supplying sheets and includes a tray. The tray is pivotally attached to the cover and movable between an open position to expose the second opening and a closed position to cover the second opening. The tray in the open position supports one or more sheets and a single sheet is supplied through the second opening to the casing.

SUMMARY

The tray includes a hook resiliently engageable with a protrusion of the cover. The tray can be held in the closed position by resilient engagement of the hook and the protrusion. When a user pulls the upper end of the tray, the hook is disengaged from the protrusion, and thus the tray pivots to the front.

The tray is held in the closed position due to a resilient force of the hook, which determines a force to hold the tray in the closed position. In designing the tray to be openable with less force in view of ease of use, a reduced resilient force of the hook may be used to reduce the force to hold the tray in the closed position.

The reduced resilient force of the hook, however, may cause the hook to come off from the protrusion too easily, due to an impact occurring when the cover is opened with the tray in the closed position, so that the tray may be unintentionally opened. To prevent such a problem, some degree of force to hold the tray in the closed position is required.

Illustrative aspects of the disclosure provide an image forming apparatus including a cover and a tray attached to the cover, enabling the tray to be opened in no need of much force when the cover is closed and to resist opening due to an impact occurring when the cover is opened.

An image forming apparatus according to one aspect of the disclosure includes a casing having a first opening, a cover attached to the casing and having a second opening, a tray attached to the cover, an engaging mechanism, and an elastic member. The cover has an upper end portion and a lower end portion. The cover is pivotable around a first pivot axis located nearer to the lower end portion than to the upper end portion such that the upper end portion moves between a closed position to cover the first opening of the casing and an open position to expose the first opening of the casing. The tray has an upper end portion and a lower end portion.

The tray is pivotable about a second pivot axis such that the upper end portion moves between an accommodated position to cover the second opening of the cover and a use position to expose the second opening of the cover. The lower end portion of the tray is disposed below the second pivot axis. The engaging mechanism is configured to engage the tray in the accommodated position with the cover. The elastic member is configured to press the lower end portion of the tray such that the tray moves from the accommodated position toward the use position.

According to the above structure, when the cover is in the closed position and the tray is in the accommodated position, the elastic member presses the tray in a direction such that the tray pivots toward the use position. This facilitates release of the engagement between the cover and the tray, thus enabling the tray to be opened with much less force. When the cover pivots from the closed position toward the open position, the tray pivots along with the cover, and the force from the elastic member becomes reduced. Thus, if the cover is stopped on impact in the open position, the force to engage the cover and the tray would prevent the tray from being opened.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

[Exterior Feature of Image Forming Apparatus]

Figure 1:
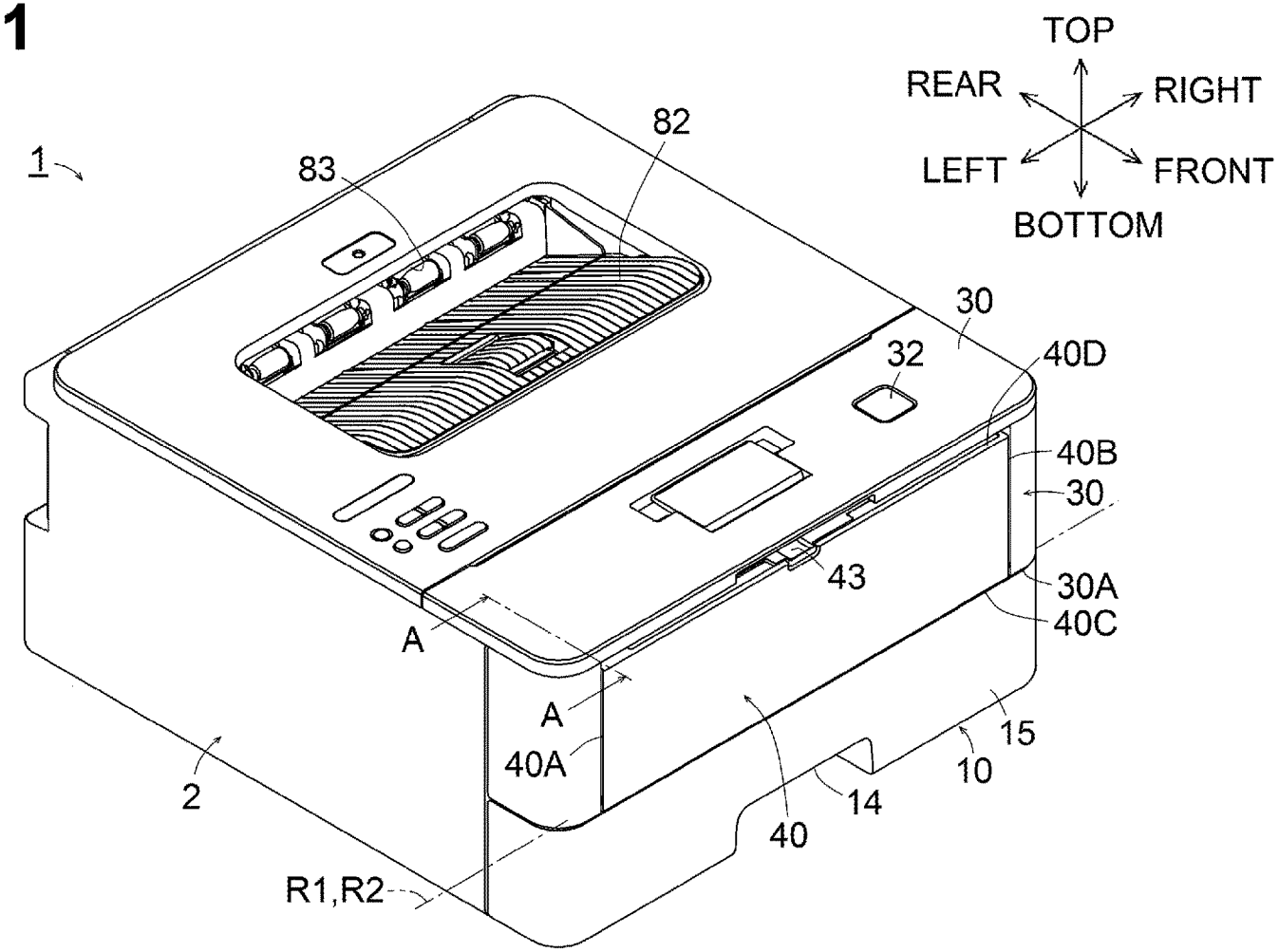
FIG. 1 is a perspective view of an image forming apparatus according to an illustrative embodiment.
Figure 2:
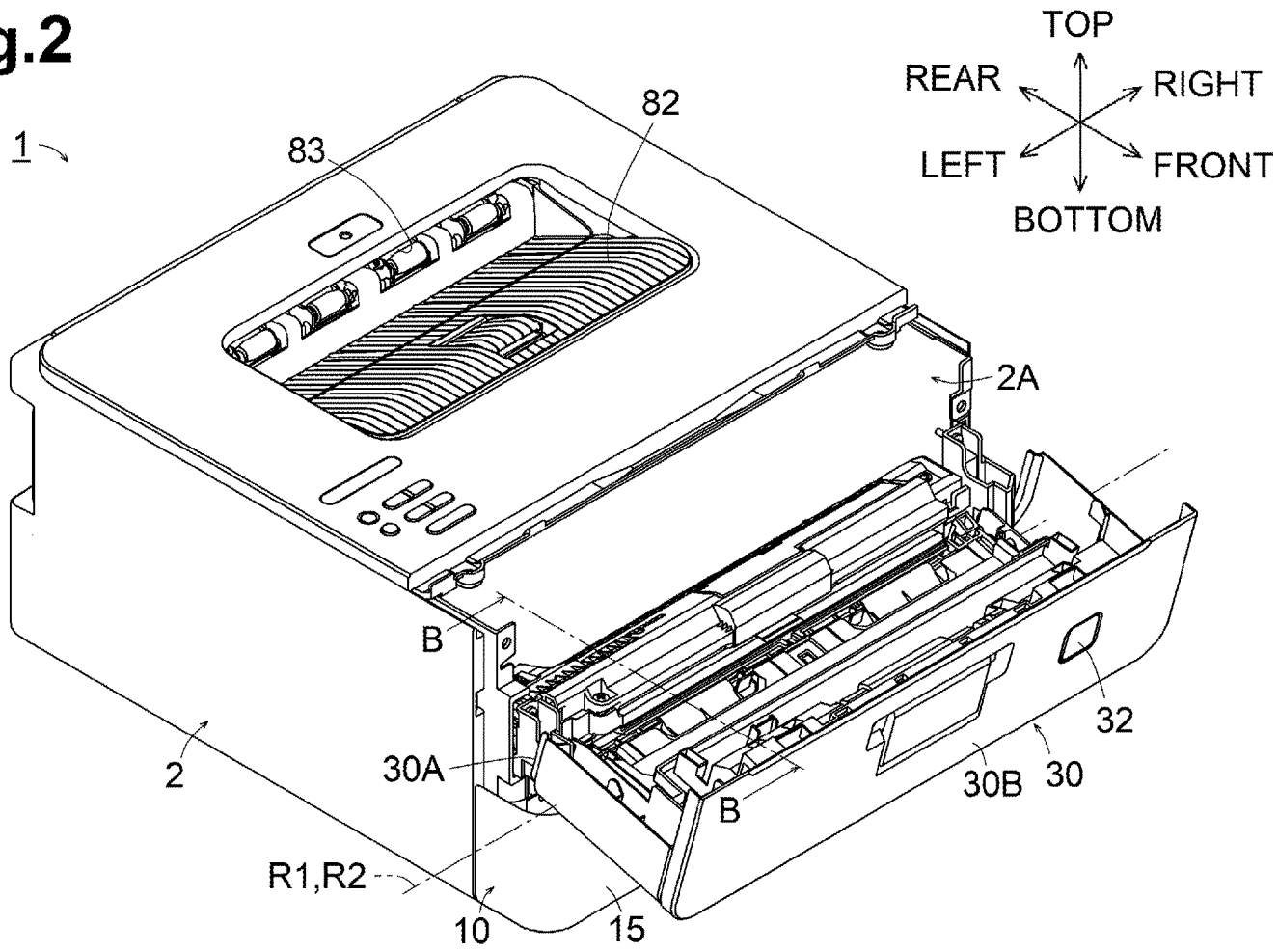
FIG. 2 is a perspective view of the image forming apparatus.
Figure 3:
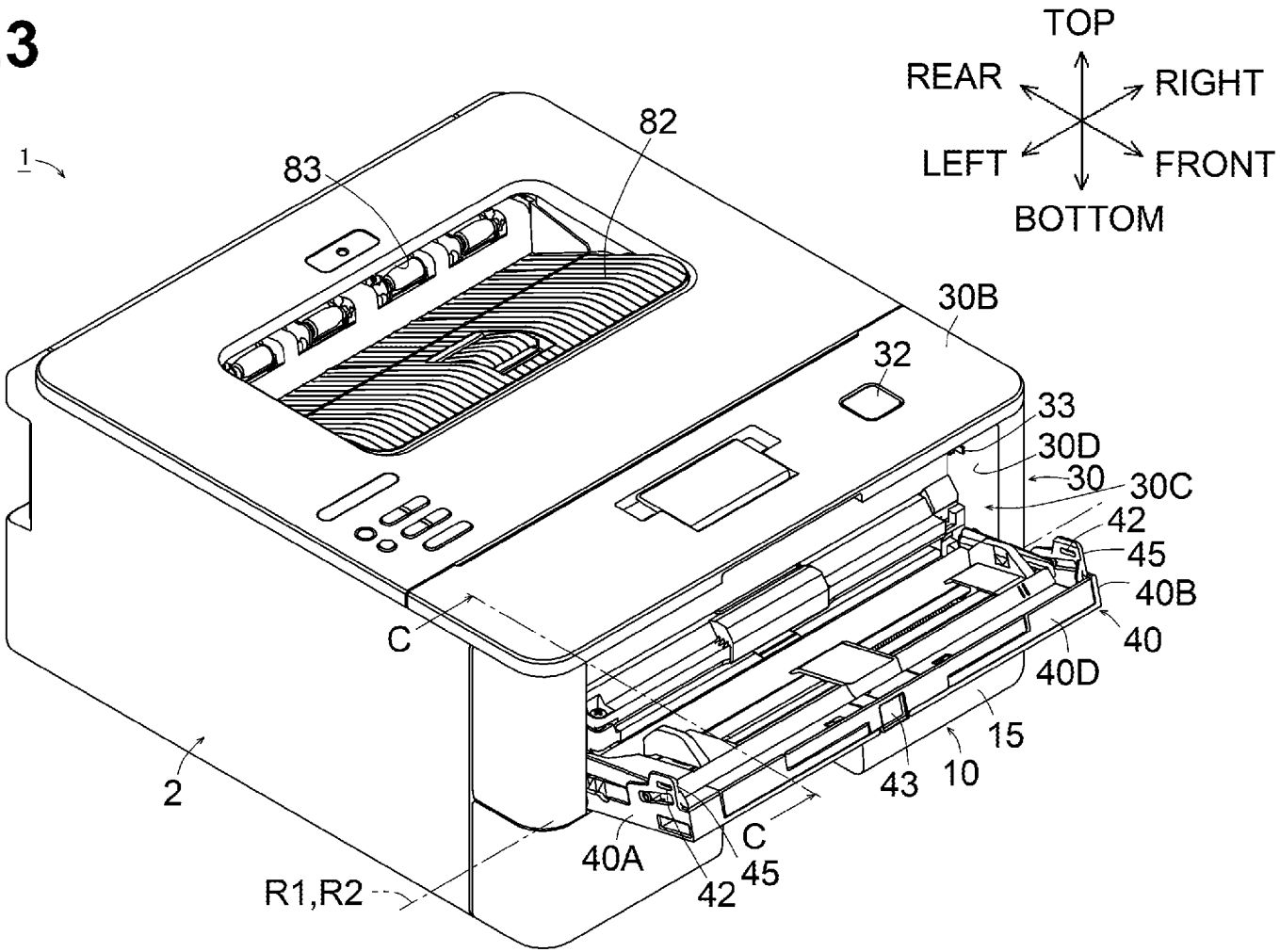
FIG. 3 is a perspective view of the image forming apparatus.
Figure 4:
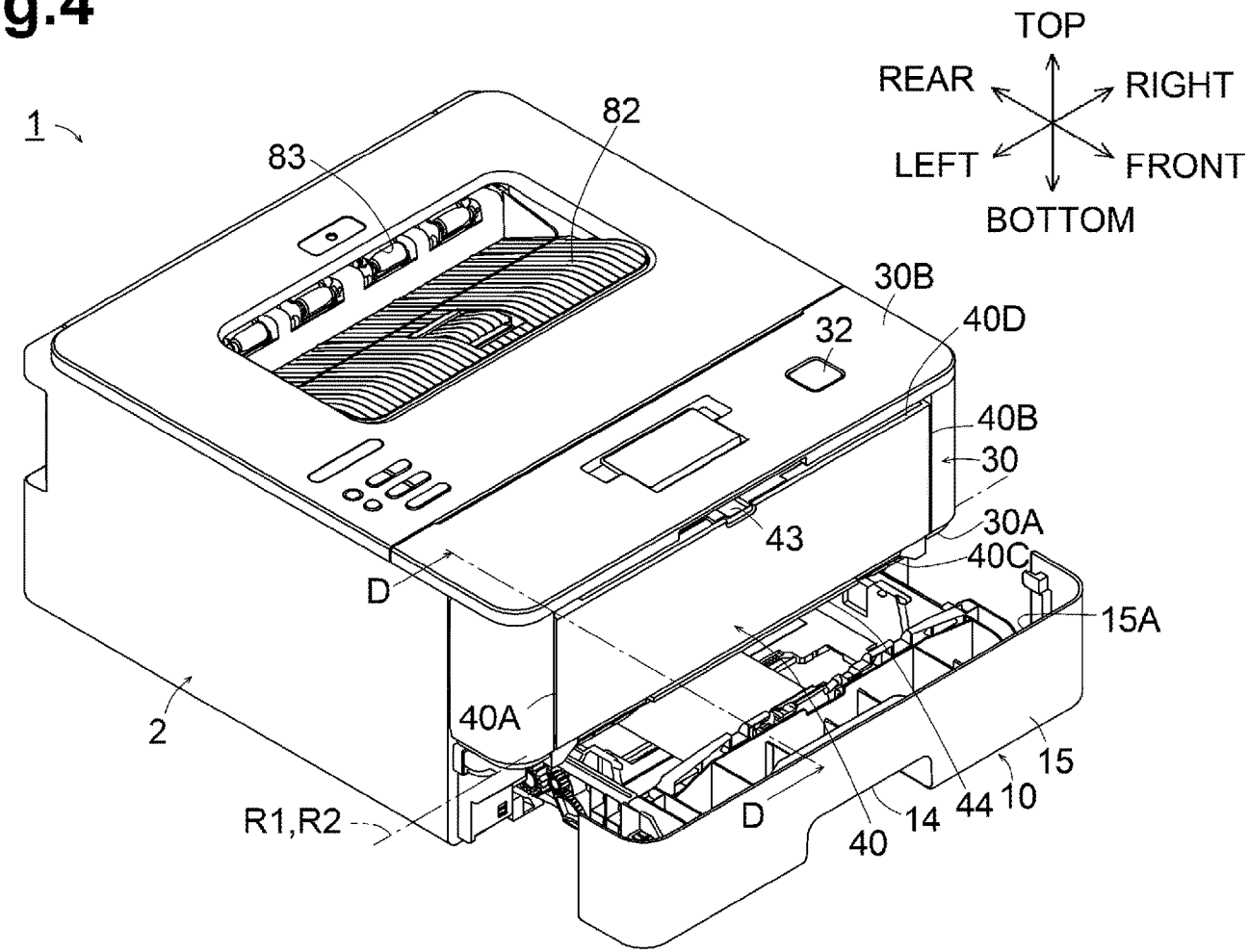
FIG. 4 is a perspective view of an image forming apparatus.

FIGS. 1-4 are perspective views of an image forming apparatus 1 according to an embodiment. FIG. 1 illustrates that a front cover 30 is closed. FIG. 2 illustrates that the front cover 30 is open. FIG. 3 illustrates that a multi-purpose tray (hereinafter referred to as a MP tray) 40 is open. FIG. 4 illustrates that a sheet cassette 10 is pulled out. In the following description, directions are defined based on an orientation of the image forming apparatus 1 which may be intended to be used as illustrated in FIGS. 1-4. A side of the image forming apparatus 1 on which a front cover 30 is disposed is the front or front side, its opposite side is the rear or rear side, left and right sides of the image forming apparatus 1 are defined when viewed from the front cover 30. A side of the image forming apparatus 1 on which a discharge tray 82 is disposed is the top or top side, and its opposite side is the bottom or bottom side.

As illustrated in FIG. 1, the image forming apparatus 1 includes a box-shaped casing 2. The casing 2 includes, at its upper surface, the discharge tray 82 to receive a printed sheet discharged from the casing 2. The discharge tray 82 has an inclined surface inclined downward to the rear. A discharge port 83 is provided at the rear of the inclined surface.

As illustrated in FIG. 2, the casing 2 has, at a front side, a first opening 2A for clearing a sheet jam or replacing an image forming unit. The front cover 30 is attached to the casing 2 to cover the first opening 2A. The front cover 30 has front cover shaft portions 31 (FIG. 6) each near one of left and right lower end portions 30A (one of which is illustrated in FIG. 2). The front cover shaft portions 31 are rotatably supported in holes (not illustrated) in the casing 2. The front cover shaft portions 31 have a first pivot axis R1 extending parallel to a bottom surface of the casing 2 and in the left-right direction. The casing 2 may have shaft portions and the front cover 30 may have holes to support the shaft portions rotatably. The front cover 30 is pivotable about the first pivot axis R1 between a closed position (FIG. 1) where an upper end portion 30B covers the first opening 2A and an open position (FIG. 2) where the upper end portion 30B exposes the first opening 2A.

As illustrated in FIG. 1, the front cover 30 is illustrated as being in the closed position. An upper surface of the front cover 30 contains, near the right end, a button 32 to be pressed for opening the front cover 30. The button 32 located at the upper surface of the front cover 30 is easy to see and press. When the front cover 30 is in the closed position and the button 32 is pressed, a lock mechanism (not illustrated) accommodated in the front cover 30 is released, and the front cover 30 is pivotable in a direction toward the open position. Thus, a user can open the front cover 30 frontward until the front cover 30 reaches the open position illustrated in FIG. 2.

As illustrated in FIG. 3, the front cover 30 has a second opening 30C for manually feeding a sheet. The MP tray 40 for supporting one or more sheets to be manually fed is attached to the front cover 30 to cover the second opening 30C. The MP tray 30 has MP tray shaft portions 41 (FIG. 6) each at one of a left end portion 40A and a right end portion 40B near a lower end portion 40C. The MP tray shaft portions 41 are rotatably supported at the front cover 30. The MP tray shaft portions 41 are an example of a first shaft and a second shaft, and has a second pivot axis R2. The front cover 30 may include shaft portions and the MP tray 40 may have holes to support the shaft portions rotatably. The MP tray 40 is pivotable about the second pivot axis R2 between an accommodated position (FIG. 1) where an upper end portion 40D covers the second opening 30C and a use position (FIG. 3) where the upper end portion 40D of the MP tray 40 exposes the second opening 30C.

The embodiment illustrates that the first pivot axis R1 is coaxial with the second pivot axis R2. A pivoting range of a lower portion of the front cover 30 below the first pivot axis R1 partially overlaps a pivoting range of a lower portion of the MP tray 40 below the second pivot axis R2. This minimize a space for pivotal movement of the lower portions of the front cover 30 and the MP tray 40 below the axes R1, R2, thus obviating the necessity to increase the physical size of the image forming apparatus 1. The first pivot axis R1 and the second pivot axis R2 may be different from each other.

An engaging mechanism configured to engage the MP tray 40 in the accommodated position with the front cover 30 is located at left and right portions of the front cover 30 and the MP tray 40 above the second pivot axis R2. As illustrated in FIG. 3, the engaging mechanism includes hooks 33 (one of which is illustrated) disposed at the front cover 30, and holes 42 formed in the MP tray 40 to engage with the hooks 33. Alternatively, the hooks 33 may be disposed at the MP tray 40, and the holes 42 may be formed in the front cover 30.

As illustrated in FIG. 1, the MP tray 40 include, at its upper end portion 40D, a recessed handle 43 used for opening the MP tray 40. The user opens the MP tray 40 by pulling at the recessed handle 43 frontward.

A sheet cassette 10 is disposed in a lower portion of the image forming apparatus 1. The sheet cassette 10 is slidable between a mounted position (FIG. 1) where the sheet cassette 10 is mounted in a lower portion of the casing 2 below the MP tray 40 and a pulled position in which the sheet cassette 10 is pulled out from the casing 2 (may be pulled out further than in a state illustrated in FIG. 4). The sheet cassette 10 includes, at its lower end portion, a recessed handle 14 used for moving the sheet cassette 10. The user pulls the sheet cassette 10 in the mounted position by pulling at the recessed handle 14 frontward.

[Internal Structure of Image Forming Apparatus]

Figure 5:
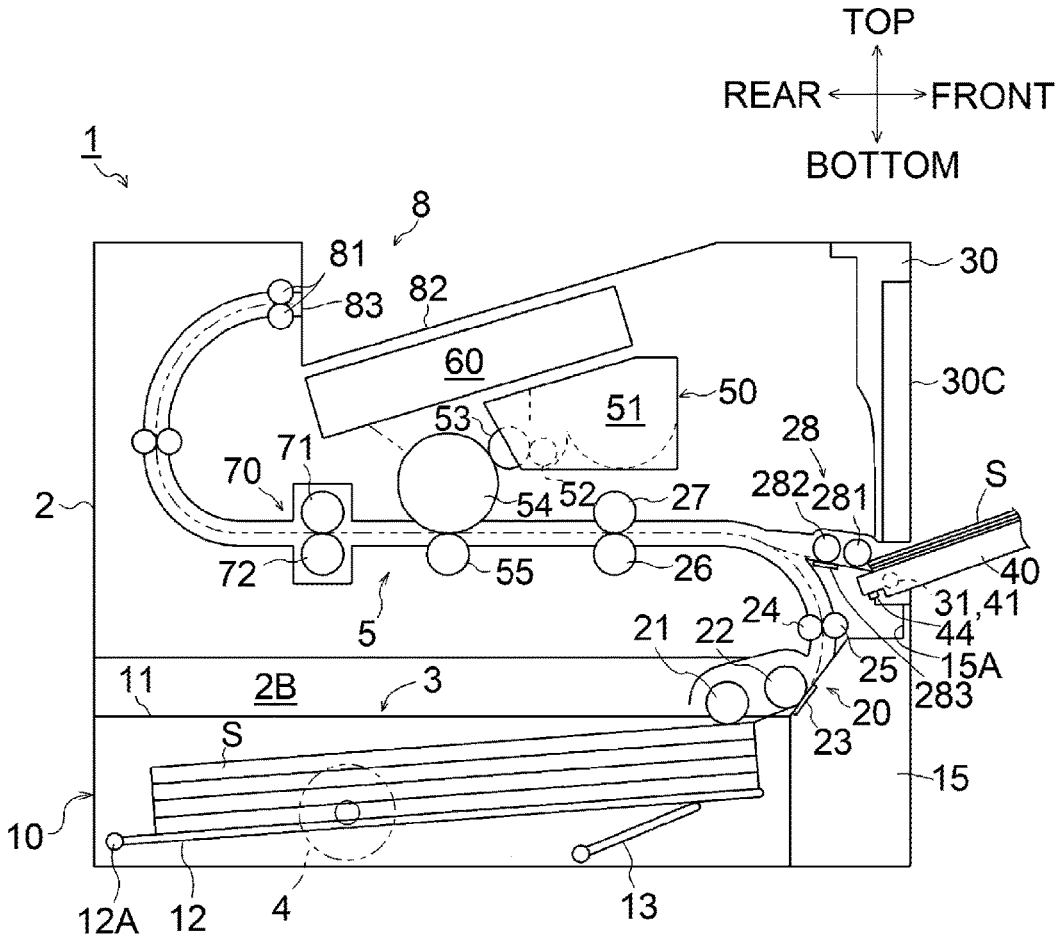
FIG. 5 is a sectional view of the image forming apparatus.

FIG. 5 is a sectional view of the image forming apparatus 1. The image forming apparatus 1 includes a supply unit 3, a motor 4, an image forming unit 5, and a discharge unit 8.

The supply unit 3 is disposed in a lower front portion of the image forming apparatus 1, and configured to convey a sheet S held in the supply unit to the image forming unit 5. The image forming unit 5 is disposed downstream of the supply unit 3 in a sheet conveying direction where a sheet S is conveyed, and configured to form an image on the sheet S conveyed from the supply unit 3. The discharge unit 8 is disposed downstream of the image forming unit 5 in the sheet conveying direction, and configured to discharge the sheet S having the image formed at the image forming unit 5 outside of the image forming apparatus 1.

The supply unit 3 includes, in a lower portion of the image forming apparatus 1, the sheet cassette 10, a feeder 20, a conveying roller 24, a registration roller 26. The supply unit 3 includes, in a front portion of the image forming apparatus 1, a MP tray 40, and a MP-side feeder 28.

The sheet cassette 10 is removably mounted in a sheet cassette mounted portion 2B, which is located in a lower portion of the casing 2. The sheet cassette 10 is inserted into the sheet cassette mounted portion 2B from the front to the rear in FIG. 5, to be located in the mounted position. The sheet cassette 10 is pulled out from the sheet cassette mounted portion 2B from the rear to the front in FIG. 5, to be located in the pulled position.

The sheet cassette 10 includes a cassette body 11 configured to support sheets S, a pressing plate 12 configured to receive sheets thereon and move vertically, and a pressing plate raising member 13 configured to raise the pressing plate 12.

The pressing plate 12 is supported at the sheet cassette 10 such that it is vertically pivotable about a pivot axis 12A. The pressing plate raising member 13 is driven by the motor 4, and an end portion of the raising member 13 moves upward. The raising member 13 moving upward raises the pressing plate 12 until the upper sheet S of the sheets S on the pressing plate 12 reaches a sheet supply position illustrated in FIG. 5.

The feeder 20 is configured to separate a single sheet S from sheets S supported at the sheet cassette 10 and feed the sheet S toward the conveying roller 24. The feeder 20 includes a pickup roller 21, a separation roller 22, and a separation pad 23. The separation roller 22 is an example of a roller configured to feed the sheet S supported at the sheet cassette 10.

The pickup roller 21 is located above the pressing plate 12 and configured to contact and pick a sheet S raised by the pressing plate 12 to the sheet supply position. The separation roller 22 is disposed downstream of the pickup roller 21 in the sheet conveying direction. The separation pad 23 faces the separation roller 22 and is urged to the separation roller 22.

When the pickup roller 21 rotates in contact with the uppermost sheet S, the uppermost sheet S and a few subsequent sheets S are fed toward the separation roller 22. Although the sheets S are introduced into between the separation roller 22 and the separation pad 23, only the uppermost sheet S is separated from the subsequent sheets S, and conveyed toward the conveying roller 24.

The conveying roller 24 is disposed downstream of the feeder 20 in the sheet conveying direction and configured to apply a conveying force to the sheet S. The conveying roller 24 faces a dust removing roller 25. The sheet S conveyed from the feeder 20 toward the conveying roller 24 is pinched between the conveying roller 24 and the dust removing roller 25, and then conveyed toward a registration roller 26.

The registration roller 26 is disposed downstream of the conveying roller 24 in the sheet conveying direction. The registration roller 26 faces a registration roller 27. The registration rollers 26, 27 temporarily stop the sheet S and convey the sheet S to a transfer position exactly at a specified moment.

The MP tray 40 is configured to support a stack of sheets S. The MP-side feeder 28 is configured to separate a single sheet S from the stack of sheets S supported at the MP tray 40 and feed the sheet S toward the registration roller 26. The MP-side feeder 28 includes a MP pickup roller 281, a MP separation roller 282, and a MP separation pad 283.

The MP pickup roller 281 is configured to contact and pick a sheet S supported at the MP tray 40. The MP separation roller 282 is disposed downstream of the MP pickup roller 281 in the sheet conveying direction. The MP separation pad 283 faces the MP separation roller 282 and is urged to the MP separation roller 282.

When the MP pickup roller 281 rotates in contact with the uppermost sheet S, the uppermost sheet S and a few subsequent sheets S are fed toward the MP separation roller 282. Although the sheets S are introduced into between the MP separation roller 282 and the MP separation pad 283, only the uppermost sheet S is separated from the subsequent sheets S, and conveyed toward the registration roller 26.

The image forming unit 5 includes a process cartridge 50 configured to transfer an image on a surface of the sheet S conveyed from the supply unit, an exposure unit 60 configured to expose a surface of a photosensitive drum 54 of the process cartridge 50, and a fixing unit 70 configured to fix the image on the sheet S.

The process cartridge 50 is located above the sheet cassette mounted portion 2B in the casing 2. The process cartridge 50 includes a developer chamber 51, a supply roller 52, a developing roller 53, the photosensitive drum 54, a transfer roller 55.

The developer chamber 51 stores developer, e.g., toner. Toner stored in the developer chamber 51 is conveyed to the supply roller 52 while being agitated by an agitator (not illustrated). The supply roller 52 supplies toner from the developer chamber 51 toward the developing roller 53.

The developing roller 53 is disposed in contact with the supply roller 52 to carry thereon toner, which is supplied from the supply roller 52 and positively charged by a sliding member (not illustrated). The developing roller 53 is subjected to positive developing bias by a biasing device (not illustrated).

The photosensitive drum 54 is disposed adjacent to the developing roller 53. The surface of the photosensitive drum 54 is uniformly charged by a charger (not illustrated), and then selectively exposed by the exposure unit 60. Exposed areas of the photosensitive drum 54 are lower in potential than the other areas not exposed, thus forming an electrostatic latent image on the surface of the photosensitive drum 54 based on image data. The electrostatic latent image on the surface of the photosensitive drum 54 is developed into a developer image with positively charged toner supplied from the developing roller 53.

The transfer roller 55 is disposed facing the photosensitive drum 54, and is subjected to negative transfer bias by a biasing device (not illustrated). The transfer roller 55 being biased and the photosensitive drum 54 carrying the developer image convey a sheet to a transfer position between the transfer roller 55 and the photosensitive drum 54, and the developer image on the surface of the photosensitive drum 54 is transferred onto a surface of the sheet S.

The exposure unit 60 includes elements, not illustrated, such as a laser diode, a polygon mirror, at least one lens, and at least one reflecting mirror, and is configured to expose the surface of the photosensitive drum 54 by irradiating the surface of the photosensitive drum 54 with laser beam as modulated based on image data input to the image forming apparatus 1.

The fixing unit 70 includes a heat roller 71 and a pressure roller 72. The heat roller 71 is driven to rotate by the motor 4, and the heat roller 71 is heated by receiving electricity from a power supply (not illustrated). The pressure roller 72 is disposed in contact with the heat roller 71 to be driven to rotate by the heat roller 71. The heat roller 71 and the pressure roller 72 nip and convey the sheet S having the transferred developer image therebetween to fix the developer image to the sheet S.

The discharge unit 8 includes a pair of discharge rollers 81 and the discharge tray 82. The discharge rollers 81 are configured to discharge the sheet S conveyed from the fixing unit 70 outside of the casing 2. The discharge tray 82 is located on the upper surface of the casing 2 to receive the sheet S discharged outside of the casing 2 by the discharge rollers 81.

[Elastic Member]

As illustrated in FIG. 4, an elastic member 44 is fixed to the lower end portion 40C at the front surface of the MP tray 40. The elastic member 44 is shaped like a box extending in the left-right direction. Double-faced tape or adhesive may be used to fix the elastic member 44. The elastic member 44 may be fixed to any portion of the front surface of the MP tray 40 as long as it is below the second pivot axis R2. Alternatively, the elastic member 44 may be fixed to the sheet cassette 10 such that, when the sheet cassette 10 is in the accommodated position, the elastic member 44 contacts a lower portion of the front surface of the MP tray 40 below the second pivot axis R2. The elastic member 44 may have any shape such as a triangular prism and a circular cylinder, other than a box shape. Alternatively, the elastic member 44 may be located at different positions along the lower end portion 40C of the MP tray 40.

Examples of the elastic member 44 include a sponge member. The sponge member used herein refers to a synthetic or rubber foam, which is deformable easily by an external force and will return to its original state when the force is released. The sponge member may be produced by, for example, cutting out from a sponge plate having a specified thickness or foam molding. A sponge type elastic member 44 may be produced inexpensively, and have a high effect of shielding operational sound inside the image forming apparatus 1.

Figure 6:
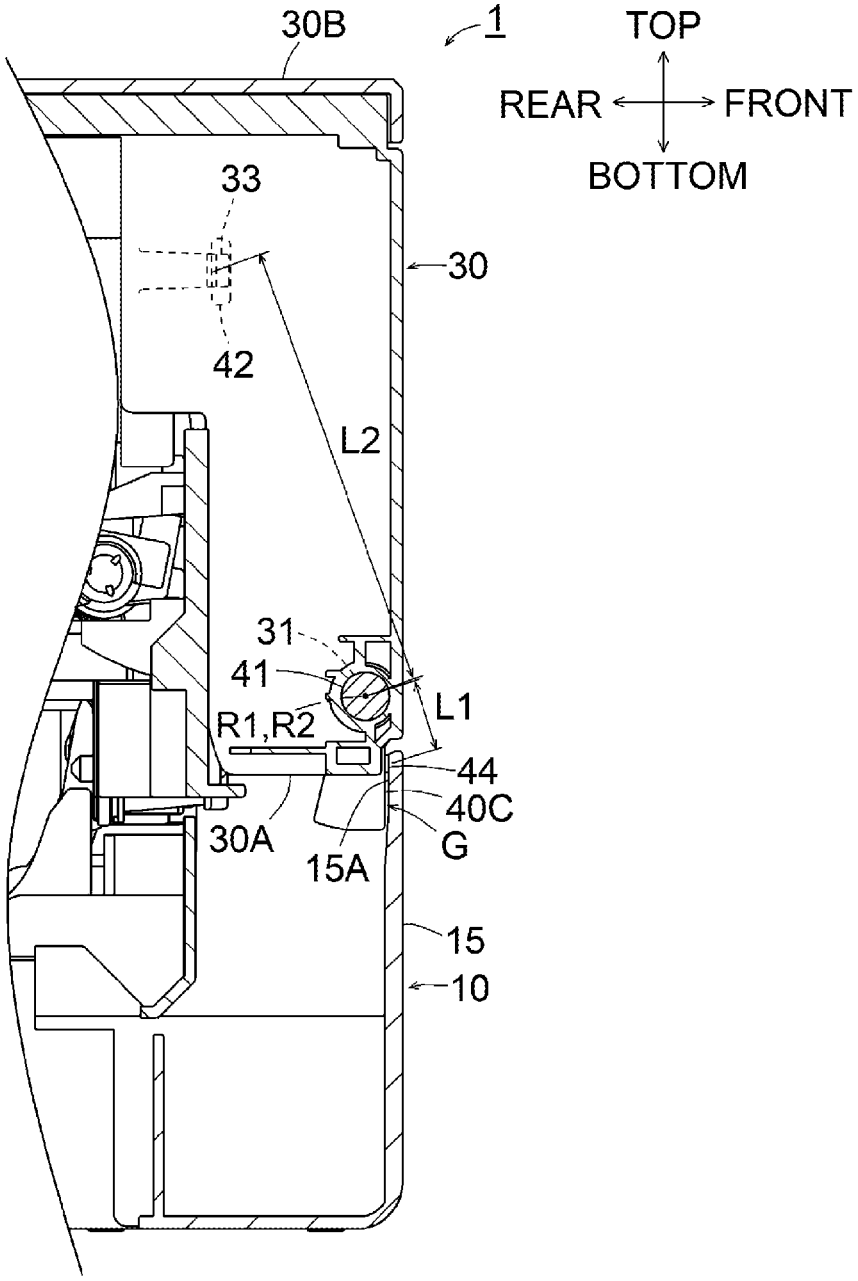
FIG. 6 is a cross section taken along a line A-A in FIG. 1.

FIG. 6 is a cross section taken along a line A-A in FIG. 1. In a state illustrated in FIG. 6, the front cover 30 is in the closed position, the MP tray 40 is in the accommodated position, and the sheet cassette 10 is in the mounted position. The sheet cassette 10 includes a pressing portion 15A. The pressing portion 15A is located at a portion of the sheet cassette 10 facing the elastic member 44 in a direction where the sheet cassette 10 is slid, that is, an inner upper end portion of the sheet cassette 10.

In the state illustrated in FIG. 6, the elastic member 44 is disposed in a gap G between the pressing portion 15A of the sheet cassette 10 and the lower end portion 40C of the MP tray 40. The elastic member 44 has thickness greater in the front-rear direction than the gap G. The elastic member 44 is thus nipped and compressed between the pressing portion 15A of the sheet cassette 10 and the lower end portion 40C of the MP tray 40.

The elastic member 44 is compressed toward the rear by the pressing portion 15A of the sheet cassette 10 in the mounted position, and presses the lower end portion 40C of the MP tray 40 such that the MP tray 40 moves rearward, that is, from the accommodated position to the use position. This facilitates release of the engagement between the hook 33 and the hole 42 when the sheet cassette 10 is in the mounted position, thus enabling opening of the MP tray 40 with much less force. The elastic member 44 in the gap G between the sheet cassette 10 and the MP tray 40 reduces sound leakage from the gap G, thus lowering the noise of the image forming apparatus 1.

The elastic member 44 is located opposite to the engaging mechanism relative to the second pivot axis R2, such that a radial distance L1 from the second pivot axis R2 to the elastic member 44 is smaller than a radial distance L2 from the second pivot axis R2 to the engaging mechanism. Each individual elastic member 44 may have a different pressing force, which acts on the engaging mechanism. This positional relationship, however, uses the principles of leverage to reduce variations in the pressing force of the elastic member 44, thus stabilizing a force required to open the MP tray 40.

Figure 7:
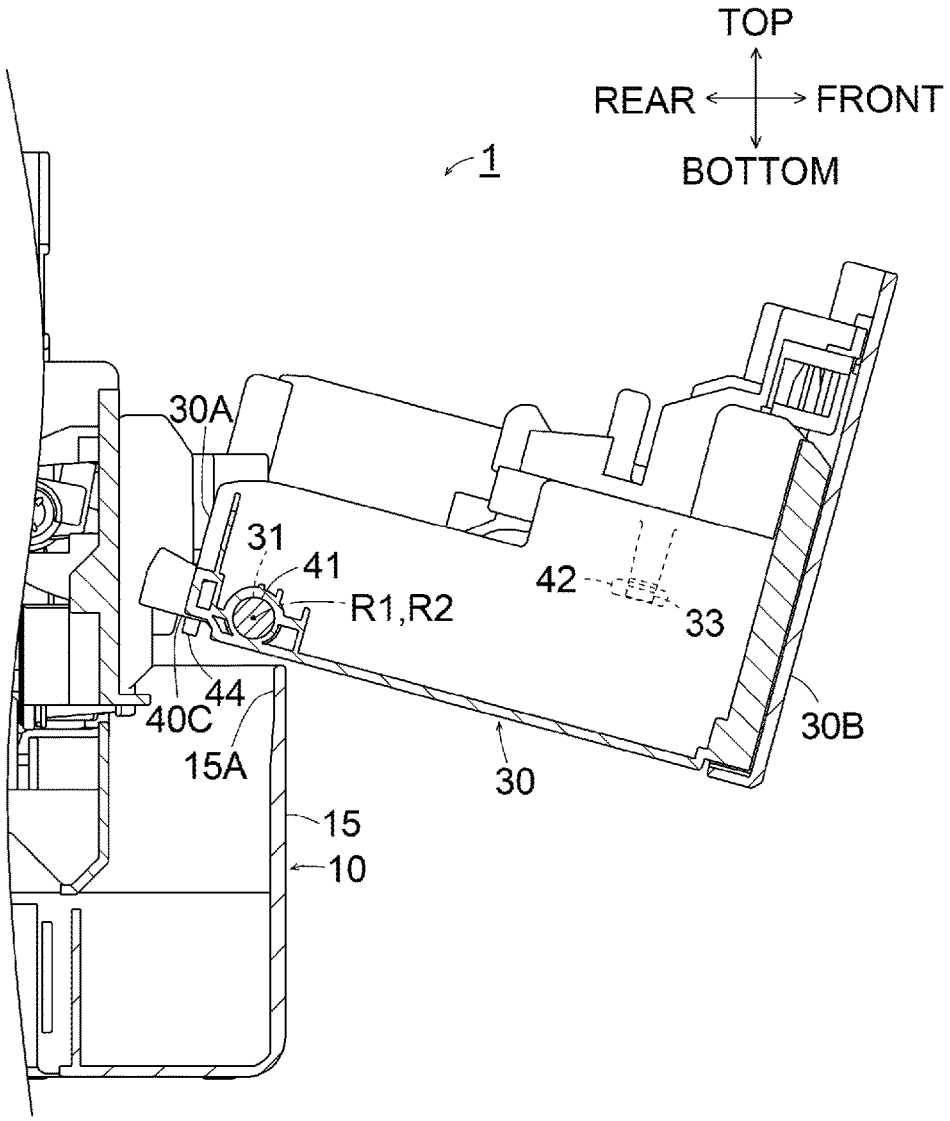
FIG. 7 is a cross section taken along a line B-B in FIG. 2.

FIG. 7 is a cross section taken along a line B-B in FIG. 2. In a state illustrated in FIG. 7, the front cover 30 is in the open position, the MP tray 40 is in the accommodated position, and the sheet cassette 10 is in the mounted position. In the state illustrated in FIG. 7, after the MP tray 40 pivots in engagement with the front cover 30, the lower end portion 40C of the MP tray 40 is orientated to the rear, and thus the elastic member 44 is apart from the pressing portion 15A of the sheet cassette 10.

As the lower end portion 40C of the MP tray 40 is not pressed by the elastic member 44, the MP tray 40 is held firmly in the accommodated position by the intrinsic engaging force of the engaging mechanism. This reduces the MP tray 40 from being opened if the front cover 30 is opened from the state illustrated in FIG. 6 and then stopped on impact in the open position illustrated in FIG. 7.

In the state illustrated in FIG. 7, the elastic member 44 may not be necessarily separated from the pressing portion 15A of the sheet cassette 10. The elastic member 44 may remain in contact with the pressing portion 15A. In this case, when the lower end portion 40C of the MP tray 40 moves rearward, a pressing force of the elastic member 44 may become reduced, the force to engage the hook 33 in the hole 42 has may become increased, and thus the MP tray 40 may be firmly held in the accommodated position.

Figure 8:
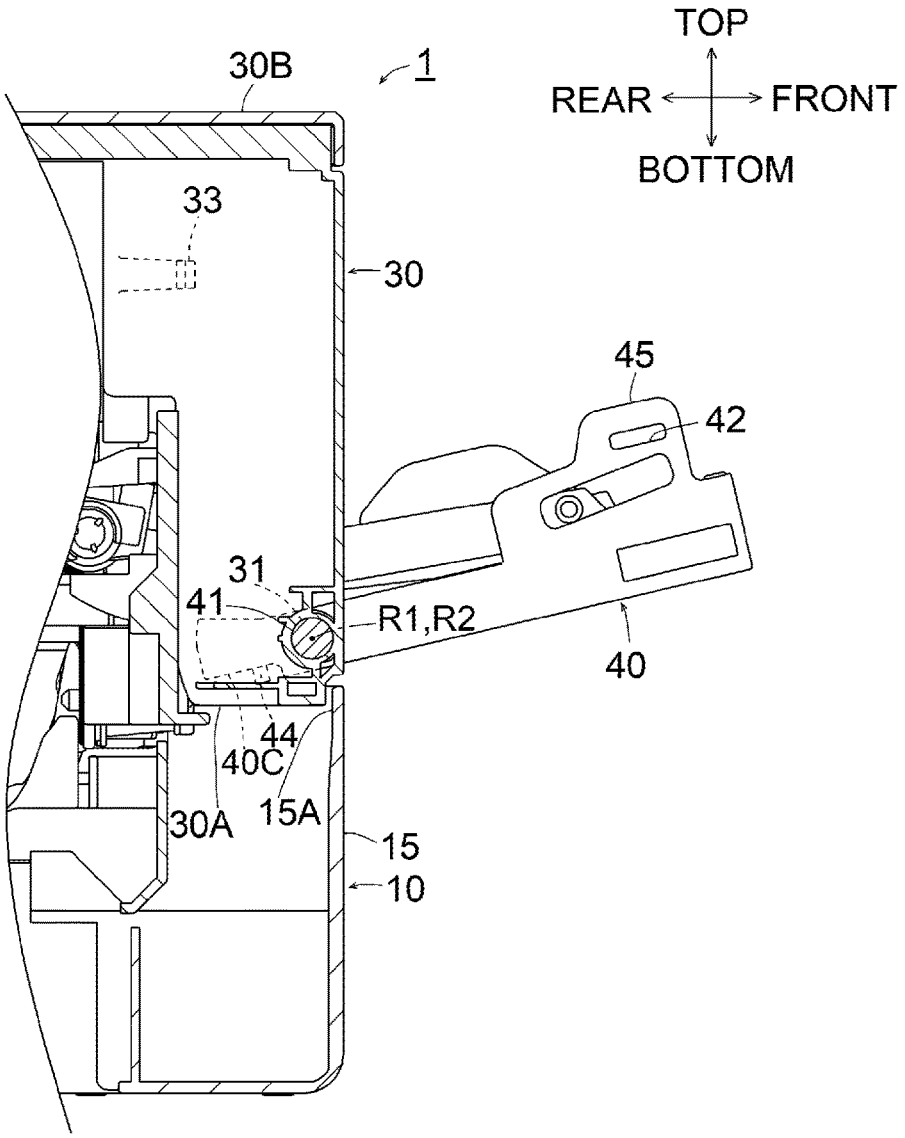
FIG. 8 is a cross section taken along a line C-C in FIG. 3.

FIG. 8 is a cross section taken along a line C-C in FIG. 3. In the state illustrated in FIG. 8, the front cover 30 is in the closed position, the MP tray 40 is in the use position, and the sheet cassette 10 is in the mounted position. As the second pivot axis R2 is coplanar with the first pivot axis R1, a lower portion of the MP tray 40 below the second pivot axis R2 partially overlaps a lower portion of the front cover 30 below the first pivot axis R1. This overlap obviates the necessity to provide a space for pivotal movement of the lower end portion 40C of the MP tray 40 separately from a space for pivotal movement of the lower end portion 30A of the front cover 30, and thus obviates the necessity to increase the physical size of the image forming apparatus 1.

Figure 9:
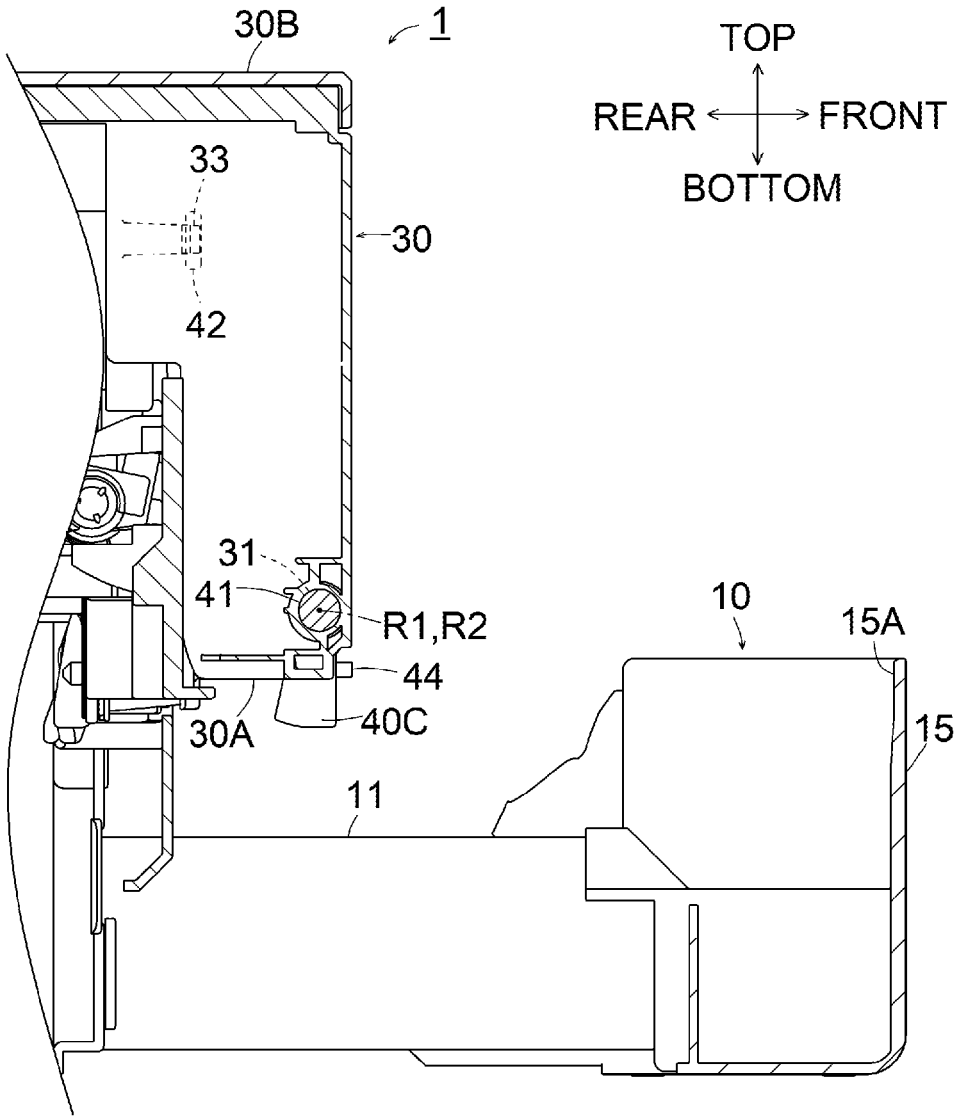
FIG. 9 is a cross section taken along a line D-D in FIG. 4.

FIG. 9 is a cross section taken along a line D-D in FIG. 4. In the state illustrated in FIG. 9, the front cover 30 is in the closed position, the MP tray 40 is in the accommodated position, and the sheet cassette 10 is between the accommodated position and the pulled position. When the sheet cassette 10 is pulled from its mounted position, the pressing portion 15A is spaced apart from the elastic member 44, and the lower end portion 40C of the MP tray 40 is not pressed by the elastic member 44. The MP tray 40 is thus held firmly at its accommodated position by the intrinsic engaging force of the engaging mechanism, and unlikely to be opened. This prevents the MP tray 40 from being opened unintentionally when the sheet cassette 10 is pulled out, so that the sheet cassette 10 can be filled with sheets S easily without any operation.

In the embodiment, the elastic member 44 is fixed to the lower end portion 40C of the MP tray 40, not to the sheet cassette 10. Thus, the user can hold the pressing portion 15A to move the sheet cassette 10.

Figure 10:
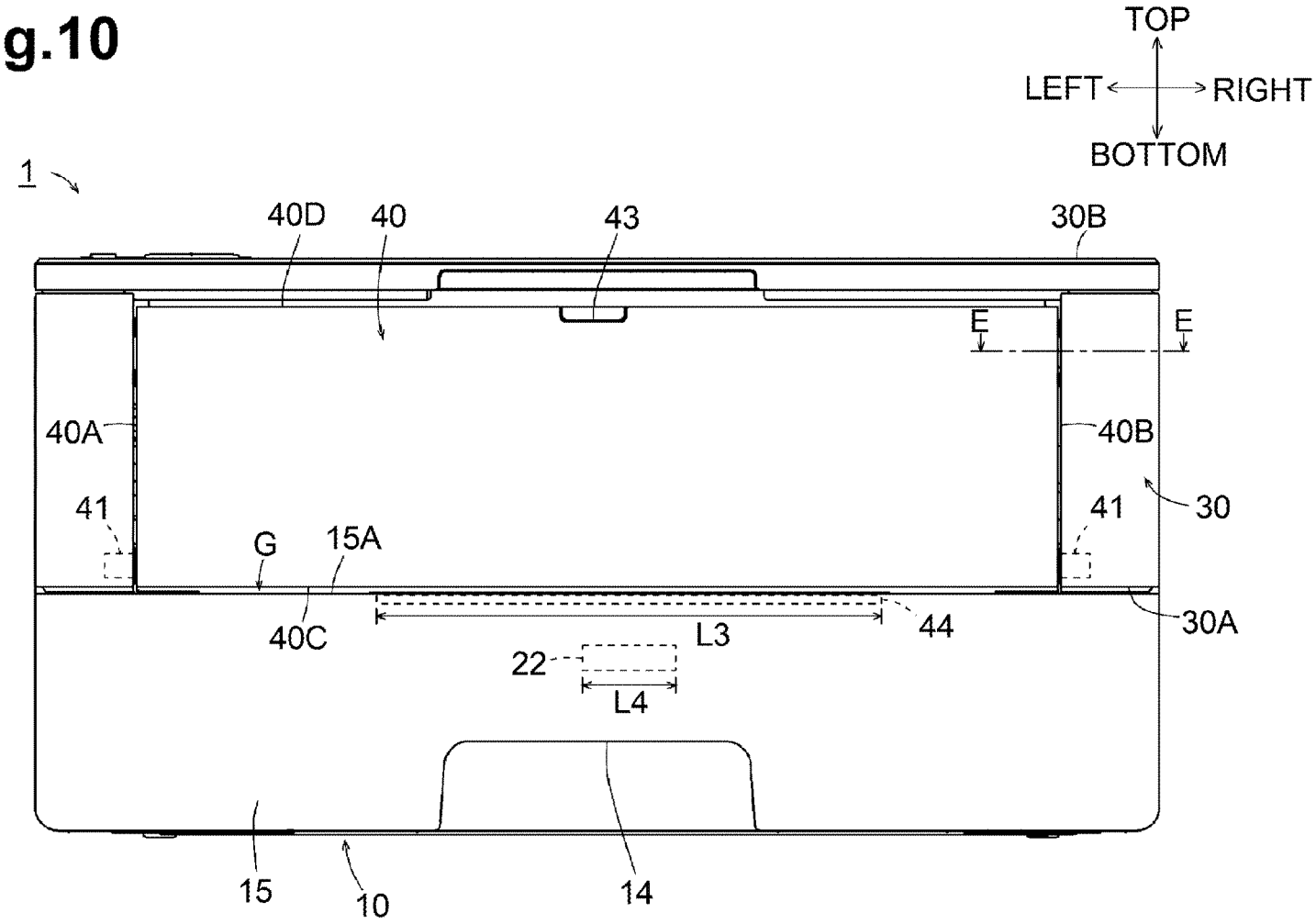
FIG. 10 is a front view of the image forming apparatus.

FIG. 10 is a front view of the image forming apparatus 1. The elastic member 44 has length L3 greater in the left-right direction than the length L4, which is a width of the separation roller 22. The elastic member 44 is disposed at a position at least overlapping the entire of the separation roller 22 in the left-right direction.

This disposition allows the elastic member 44 to efficiently shield operating noise produced every time the separation roller 22 separates a sheet S so as not to leak the noise from the gap G between the pressing portion 15A of the sheet cassette 10 and the lower end portion 40C of the MP tray 40, thus lowering the noise of the image forming apparatus 1.

[Engaging Mechanism]

Figure 11A:
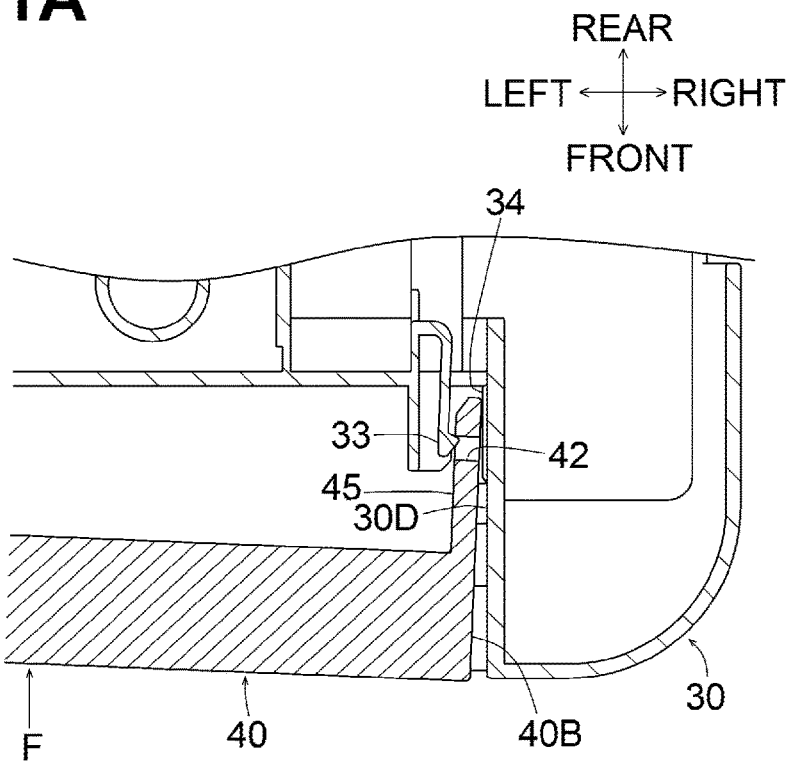
FIG. 11A is a schematic cross section taken along a line E-E in FIG. 10.
Figure 11B:
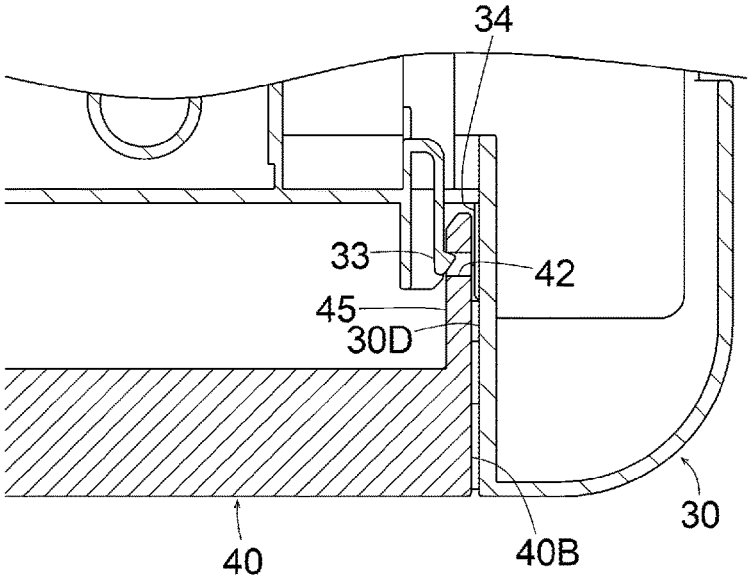
FIG. 11B is a schematic cross section when a sheet cassette is pulled out from a state in FIG. 10.
Figure 12:
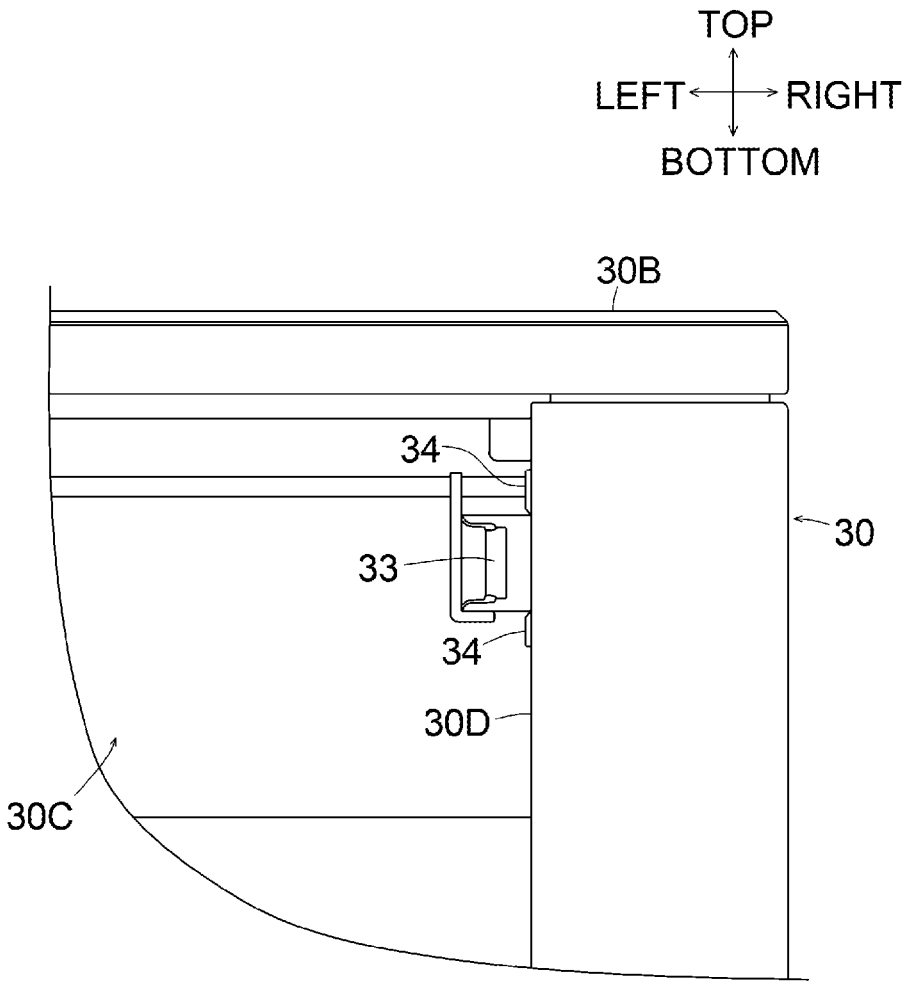
FIG. 12 is a partial front view of the image forming apparatus when the MP tray is in a use position.

FIG. 11A is a schematic cross section taken along a line E-E in FIG. 10, and FIG. 11B is a schematic cross section when a sheet cassette 10 is pulled out from a state in FIG. 11A. FIG. 12 is a partial front view of the image forming apparatus 1 when the MP tray 40 is in the use position. The following description will be made based on the right engaging mechanism located in the right portions of the front cover 30 and the MP tray 40 since it is similar and symmetrical to the left engaging mechanism located in the left portions of the front cover 30 and the MP tray 40.

As illustrated in FIG. 12, the hook 33 is located near the upper end of a right inner side surface 30D of the front cover 30. As illustrated in FIGS. 11A and 11B, the hook 33 is integral with a resin member constituting the front cover 30 and is U-shaped. The hook 33 has a protrusion protruding to the right at its right end. The resin-made and U-shaped hook 33 is resilient. When pressed by a portion defining the hole 42, the hook 33 is bent to the left and engaged with or disengaged from the hole 42.

As illustrated in FIGS. 11A and 11B, the hole 42 is formed in a protrusion 45 extending from the right end portion 40B of the MP tray 40 toward rear, and passes through the protrusion 45 in the left-right direction. The protrusion 45 includes the portion defining the hole 42.

The right inner side surface 30D of the front cover 30 has two ribs 34 extending in the front-rear direction close to a position facing the hook 33. In the state illustrated in FIG. 11B, the ribs 34 are provided for reducing a gap between the portion defining the hole 42 and the right inner side surface 30D of the front cover 30. The ribs 34 function as abutment surfaces to hold the portion defining the hole 42, and prevents the MP tray 40 from being opened unintentionally. In the absence of the ribs 34, the hook 33 would be disengaged from the hole 42 due to an impact occurring when the sheet cassette 10 stops in the mounted position, and thus the MP tray 40 would be opened unintentionally.

In the example illustrated in FIG. 11B, when the sheet cassette 10 is pulled, the MP tray 40 is not pressed by the elastic member 44, and thus the hook 33 in its original state is engaged in the hole 42. Accordingly, the MP tray 40 is firmly held in the accommodated position by the intrinsic engaging force of the engaging mechanism.

As illustrated in FIG. 11A, when the sheet cassette 10 is in the mounted position, the resin-made MP tray 40 is pressed by the elastic member 44 and thus deformed in the direction F. In this state, an end portion of the protrusion 45 is bent to the right. In other words, the portion defining the hole 42 moves in a direction to release the engagement between the hook 33 and the hole 42. This facilitates release of the engagement between the hook 33 and the hole 42.

The positions of the hook 33 and the hole 42 may be reversed or changed such that one of the hook 33 and the hole 42 moves in a direction to, when the MP tray 40 is pressed by the elastic member 44 and is deformed, release the engagement between the hook 33 and the hole 42.

The deformation of the MP tray 40 varies depending on the position of the elastic member 44. In the embodiment, as illustrated in FIG. 10, the elastic member 44 is disposed between the MP tray shaft portions 41 and at a position including a center between the MP tray shaft portions 41. This increases the deformation of the MP tray 40 illustrated in FIG. 11A, and further facilitates release of the engagement between the hook 33 and the hole 42.

[Effects]

The above-described the image forming apparatus 1 includes the casing 2 having the first opening 2A in a side surface, and the front cover 30 having the second opening 30C. The front cover 30 is attached to the casing 2 and pivotable about the first pivot axis R1 such that the upper end portion 30 B moves between the closed position to cover the first opening 2A and the open position to expose the first opening 2A. The image forming apparatus 1 includes the MP tray 40. The MP tray 40 is connected to the front cover 30 and pivotable about the second pivot axis R2 such that the upper end portion 40D moves between the accommodated position to cover the second opening 30C and the use position to expose the second opening 30C. The MP tray 40 has the lower end portion 40C below the second pivot axis R2. The image forming apparatus 1 includes the engaging mechanism and the elastic member 44. The engaging mechanism is configured to engage the MP tray 40 in the accommodated position with the front cover 30. The elastic member 44 is configured to press the lower end portion 40C of the MP tray 40 such that the MP tray 40 moves from the accommodated position toward the use position.

When the front cover 30 is in the closed position and the MP tray 40 is the accommodated position, the elastic member 44 presses the MP tray 40 in a direction such that the MP tray 40 pivots toward the use position. This facilitates release of the engagement between the hook 33 and the hole 42, thus enabling the MP tray 40 to be opened with much less force. When the front cover 30 pivots from the closed position toward the open position, the MP tray 40 pivots along with the front cover 30, and the force from the elastic member 44 becomes reduced. Thus, if the front cover 30 is stopped on impact in the open position, the force to engage the hook 33 in the hole 42 would prevent the MP tray 40 from being opened.

The image forming apparatus 1 includes the sheet cassette 10. The sheet cassette 10 is movable between the mounted position in which the sheet cassette 10 is mounted in the casing 2 below the MP tray 40 and the pulled position in which the sheet cassette 10 is pulled out from the casing 2. The sheet cassette 10 includes the pressing portion 15A facing the elastic member 44 in the sliding direction. When the front cover 30 is in the closed position, the MP tray 40 is in the accommodated position, and the sheet cassette 10 is in the mounted position, the elastic member 44 is compressed between the pressing portion 15A of the sheet cassette 10 and the lower end portion 40C of the MP tray 40.

The sheet cassette 10 in the mounted position compresses the elastic member 44, and the MP tray 40 can be opened with much less force. When the sheet cassette 10 is in the pulled position, the MP tray 40 would not be opened.

According to the above image forming apparatus 1, when the front cover 30 is in the closed position, the MP tray 40 is in the accommodated position, and the sheet cassette is in the mounted position, a gap G is produced between the lower end portion 40C of the MP tray 40 and the sheet cassette 10. Thus, the elastic member 44 is disposed in the gap G.

This configuration allows the elastic member 44 to prevent noise from leaking from the gap G, thus lowering the noise of the image forming apparatus 1.

The image forming apparatus 1 includes the separation roller 22 for feeding a sheet S supported at the sheet cassette 10, and the elastic member 44 is longer than the separation roller 22.

This configuration allows the elastic member 44 to effectively shield noise generated from the separation roller 22, thus lowering the noise of the image forming apparatus 1.

According to the above image forming apparatus 1, the elastic member 44 is fixed to the lower end portion 40C of the MP tray 40 and pressed by the sheet cassette 10.

The elastic member 44 is pressed by the sheet cassette 10. As the elastic member 44 is not disposed at the sheet cassette 10, it is out of the way when the sheet cassette 10 is moved.

According to the above image forming apparatus 1, the elastic member 44 is a sponge member.

This type of elastic member 44 is inexpensive to produce and highly effective to shield noise.

According to the above image forming apparatus 1, the elastic member 44 is disposed such that the radial distance L1 from the second pivot axis R2 to the elastic member 4 is smaller than the radial distance L2 from the second pivot axis R2 to the engaging mechanism.

Although each individual elastic member 44 may have a different pressing force, which acts on the engaging mechanism, this structure uses the principles of leverage to reduce variations in the pressing force of the elastic member 44, thus stabilizing a force required to open the MP tray 40.

According to the above image forming apparatus 1, the engaging mechanism includes the hook 33 disposed at one of the front cover 30 and the MP tray 40, and the hole 42 formed at the other of the front cover 30 and the MP tray 40. The hook 33 are the hole 42 are located at positions such that one of the hook 33 and the hole 42 moves in a direction to, when the MP tray 40 is pressed by the elastic member 44 and is deformed, release the engagement between the hook 33 and the hole 42.

The positional relationship between the hook 33 and the hole 42 is thus determined to, when the MP tray 40 is in the accommodated position, facilitate release of the engagement between the hook 33 and the hole 42.

According to the above image forming apparatus 1, the MP tray 40 has the MP tray shaft portions 41 each at one of both end portions in the direction of the second pivot axis R2, and the elastic member 44 is disposed between the MP tray shafts 41.

This structure increases the deformation of the MP tray 40 in the accommodated position, thus further facilitating release of the engagement between the hook 33 and the hole 42.

According to the above image forming apparatus 1, the first pivot axis R1 is coaxial with the second pivot axis R2.

The lower portion of the front cover 30 below the first pivot axis R1 partially overlaps the lower portion of the MP tray 40 below the second pivot axis R2. This overlap obviates the necessity to provide a space required for the lower end portion of the front cover 30 to pivot separately from a space required for the lower end portion of the MP tray 40 to pivot, and thus obviates the necessity to increase the physical size of the image forming apparatus 1.

What is claimed is:

1. An image forming apparatus comprising:

a casing having a first opening;

a cover attached to the casing and having a second opening, the cover having an upper end portion and a lower end portion, the cover being pivotable around a first pivot axis located nearer to the lower end portion than to the upper end portion such that the upper end portion moves between a closed position to cover the first opening of the casing and an open position to expose the first opening of the casing;

a tray attached to the cover and having an upper end portion and a lower end portion, the tray being pivotable about a second pivot axis such that the upper end portion moves between an accommodated position to cover the second opening of the cover and a use position to expose the second opening of the cover, the lower end portion of the tray being disposed below the second pivot axis;

an engaging mechanism configured to engage the tray in the accommodated position with the cover; and an elastic member configured to press the lower end portion of the tray such that the tray moves from the accommodated position toward the use position.

2. The image forming apparatus according to claim 1, further comprising a sheet cassette slidable between a mounted position in which the sheet cassette is mounted in a lower portion of the casing below the tray and a pulled position in which the sheet cassette is pulled out from the casing, the sheet cassette including a pressing portion, the pressing portion facing the elastic member in a direction in which the sheet cassette is slidable, wherein, when the cover is in the closed position, the tray is in the accommodated position, and the sheet cassette is in the mounted position, the elastic member is compressed between the pressing portion of the sheet cassette and the lower end portion of the tray.

3. The image forming apparatus according to claim 2, wherein the cover is in the closed position, the tray is in the accommodated position, and the sheet cassette is in the mounted position, the elastic member is disposed in a gap defined by the lower end portion of the tray and the sheet cassette.

4. The image forming apparatus according to claim 3, further comprising a roller configured to feed a sheet supported at the sheet cassette, wherein the elastic member has a length longer than or equal to a length of the roller.

5. The image forming apparatus according to claim 1, wherein the elastic member is fixed to the lower end portion of the tray.

6. The image forming apparatus according to claim 1, wherein the elastic member is a sponge member.

7. The image forming apparatus according to claim 1, wherein the elastic member is disposed such that a radial distance from the second pivot axis to the elastic member is smaller than a radial distance from the second pivot axis to the engaging mechanism.

8. The image forming apparatus according to claim 1, wherein the engaging mechanism includes a hook disposed at one of the cover and the tray and a hole formed in the other of the cover and the tray, and wherein the hook and the hole are located at positions such that one of the hook and the hole moves in a direction to, when the tray is pressed by the elastic member and is deformed, release engagement between the hook and the hole.

9. The image forming apparatus according to claim 8, wherein the tray has a first end and a second end opposite to each other relative to the second pivot axis, the tray including a first shaft portion at the first end and a second shaft portion at the second end, wherein the elastic member is disposed between the first shaft portion and the second shaft portion.

10. The image forming apparatus according to claim 9, wherein the first pivot axis is coplanar with the second pivot axis.

* * * * *